United States Patent [19]

Dorfman

[11] 4,116,443

[45] Sep. 26, 1978

[54] PIVOTING TARGET ARRAY GAME

[75] Inventor: Steven R. Dorfman, Levittown, N.Y.

[73] Assignee: L.J.N. Toys, Ltd., New York, N.Y.

[21] Appl. No.: 807,918

[22] Filed: Jun. 20, 1977

[51] Int. Cl.[2] ..... A63B 63/04; F41J 7/00

[52] U.S. Cl. ..... 273/95 R; 273/102.1 E; 273/127 D

[58] Field of Search ..... 273/102.1 E, 102 AP, 273/127 D, 102.1 R, 85 D, 85 C, 95 R

[56] References Cited

U.S. PATENT DOCUMENTS

| | | | |
|---|---|---|---|
| 1,612,946 | 1/1927 | Scarseth | 273/101 |
| 3,599,977 | 3/1969 | Glass | 273/95 R |
| 3,690,664 | 10/1970 | Hauke | 273/127 D |
| 3,854,728 | 12/1974 | Brandell | 273/127 D |

*Primary Examiner*—Richard C. Pinkham
*Assistant Examiner*—Lawrence E. Anderson
*Attorney, Agent, or Firm*—Anthony J. Casella

[57] ABSTRACT

A game apparatus includes an array of paddle-type display elements rotatably mounted in a housing, with the paddles of the display elements having suitable indicia thereon. The game may be played by actuation of selective display elements in tic-tac-toe fashion, with actuation of the paddle elements being preferably effected by tossing small bags against selective paddles. The array of display elements is arranged in a series of rows and columns in a body structure, with each display element being rotatably mounted about a shaft secured to the body structure. Each display element preferably comprises three radially extending planar portions radiating from a central hub, and an aperture is provided in the hub to which the associated shaft extends. Each aperture defines in cross-section an isosceles triangle. By this arrangement, when a tossed bag hits against any paddle of a display element, the display element is rotated and will come to rest in one of the two equal angles of the aperture in the display element, thereby displaying one of the paddles containing indicia.

7 Claims, 3 Drawing Figures

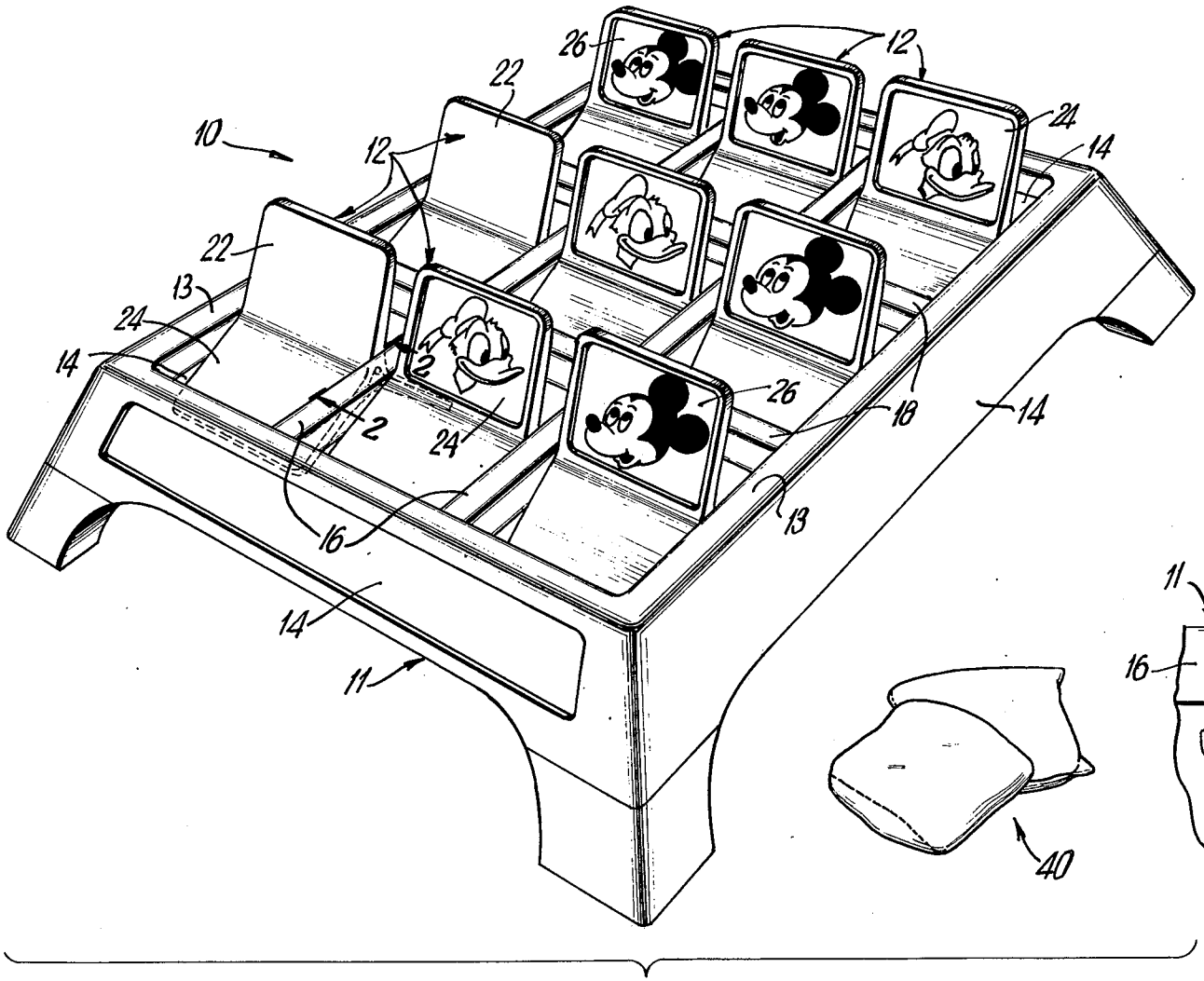
FIG.1
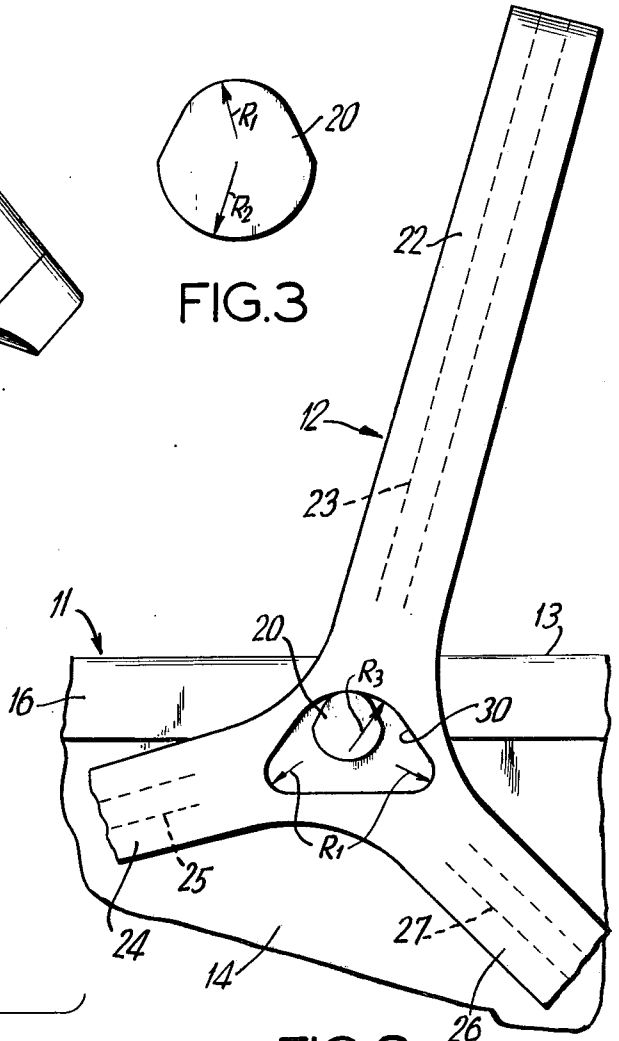
FIG.2
FIG.3

PIVOTING TARGET ARRAY GAME

The present invention relates in general to games, and more particularly, game apparatus for use in playing a variant of the popular game known as tic-tac-toe. In using the game apparatus of the subject invention, athletic skill as well as game strategy is employed.

A major object of the invention is to provide a game apparatus which is structurally very simple and yet rugged, and in which the individual display elements are easily changed from one setting to another. Desirably, each of the display elements can be changed to any of its desired settings entirely independent of any actuation of the other elements, and thus maximize the number of possible patterns which may be produced. Also, it is preferred that the individual elements each be designed for actuation between three different appearance conditions; i.e., a "neutral" or "blank" and two operative conditions corresponding to the type of game being played. Further, because of the specific structural design of the mounting mechanism for each display element and the paddle type construction thereof, when rotated, each display apparatus will most probably rest at one of two desired operative display positions.

Structurally, the individual display elements are mounted to turn about pre-determined axes, preferably by mounting the elements rotatably on a series of parallel shafts. Each of the elements is then provided with a series of display faces, one being a blank or neutral display face, while the other two contain indicia such as popular cartoon characters. The display faces are positioned for exposure in different rotary positions of the display elements. Each display element is configured as a paddle-type wheel including three equally spaced paddles radially extending from a central hub. The hub includes an aperture through which the associated support shaft extends, with the cross-section of each aperture defining an isosceles triangle. The plane of each panel is off-set relative to an associated angle of the triangularly-shaped aperture, and the largest angular portion of the aperture is disposed adjacent the "neutral" or "blank" paddle, whereas the other two equal angles are disposed respectively adjacent the remaining two paddles which contain indicia. The support shaft is pear-shaped in cross-section, and includes an upper and lower curved portion, with the radius of curvature of the upper section being less than the radius of curvature of the lower section. The two equal angles of the triangular aperture have a radius corresponding in configuration to the upper radius portion of the support shaft, while the remaining angle of the aperture is greater than the radius of curvature of the lower (i.e. greater) portion of the support shaft. By this arrangement, in the neutral position of the game apparatus, the respective shaft is lodged in the larger angle of the triangularly-shaped aperture, and thus the neutral paddle is disposed above the body structure of the apparatus, and at an acute angle with respect to the vertical. In the playing of the game, when a paddle is actuated, such as by being forcibly displaced by the tossing of a bean bag, the struck display element rotates freely about the shaft, with the air-drag effect of the paddles slowing down the rotation of the display element until the upper portion of the support shaft lodges in one of the two correspondingly-configured smaller angles of the triangularly-shaped aperture, at which time one of the paddles containing indicia is then disposed above the frame structure.

The above and other features and objects of the invention will be better understood from the following detailed description of a typical embodiment illustrated in the accompanying drawings, in which:

FIG. 1 is a perspective view of a game apparatus constructed in accordance with the subject invention;

FIG. 2 is a detailed showing of the mounting of one of the paddle-type display elements on its associated shaft; and FIG. 3 is a cross-sectional view of a support shaft.

Turning to FIG. 1, te game apparatus of the subject invention is generally designated by the numeral 10 and includes a body support or frame 11 which rotatably carries nine identical display elements, designated by the numeral 12. Body support 11 may typically be made of a rigid resinous plastic material, and is square in horizontal section, having an externally square horizontal extending top wall 13 from which there depends four generally vertical, side walls 14. The top wall 13 contains longitudinally extending ribs 16 and cross-ribs 18 which sub-divide the top wall 13 into a plurality of openings, nine of which are shown in the display apparatus in FIG. 1. Thus, the top wall 13 forms in effect a frame from which the nine display elements 12 may be seen.

Extending between the ribs 16 and the side portions of the top wall 13 are a correspondingly plurality of short shafts 20 (see FIGS. 2 and 3) which respectively rotatably support the nine display elements 12. As shown in FIG. 3, the support shaft 20 is preferably pear-shaped in configuration having an upper radius of curvature designated $R_1$. The lower radius of curvature $R_2$ of support shaft is greater than the upper radius $R_1$.

As shown in FIG. 2, each display element 12 includes radially extending paddles or planar portions 22, 24 and 26 extending from a central hub 28 with each paddle including an inset display surface 23, 25, 27, respectively. The radially extending planar portions 22, 24 and 26 are spaced at equal radial angles, i.e., 120°, and preferably one of the display surfaces (numeral 23) is a neutral or blank portion, whereas the other two display surfaces 25 and 27 contain indicia, such as the characters indicated in FIG. 1.

Extending longitudinally through the central hub 20 of each display element is an aperture 30 which in cross-section defines a generally isosceles traingle. The two equal angles of aperture 30 have a radius of curvature which corresponds to the radius of curvature $R_1$ of the upper portion of support shaft 20. The remaining angle of the aperture 30 has a radius of curvature $R_3$ which is greater than $R_1$, as well as preferably greater than $R_2$ of the support shaft. Preferably, the respective angles of the generally isosceles traingle aperture 30 are 700°, 55°, 55°, with the larger angle (for example 70° ) being disposed adjacent the blank or neutral planar portion 22. The remaining angles are disposed adjacent the paddle panels 24 and 26 which contain indicia thereon. Preferably, the larger angle is in the range of 70° to 100°. As illustrated in FIG. 2, preferably the triangular-shaped aperture 30 is off-set with respect to the radii extending from the hub to the planar portions 22, 24 and 26. By this arrangement, as shown in FIG. 2, when the support shaft 20 is disposed at the larger angle of aperture 30, adjacent the blank or neutral planar portion or panel 22, the latter is tilted at an angle of approximately 30° with respect to the vertical. This feature assists the player of the game in visualizing which planar portion of each display element is disposed above the top wall 13.

As shown in FIG. 1, the game apparatus may also include suitable means for actuating each paddle wheel display element 12, such as fabric bags 40 containing pellet-like material, simulating bean bags or the like.

In operation, all of the display elements 12 are rotated to the position whereby the respective support shaft 20 is disposed in the largest angle of the triangular-shaped aperture, and all of the neutral paddles 22 are disposed above the plane of the top wall 13. Because of the off-set of the generally triangular-shaped aperture with respect to the paddles, the neutral paddles are tilted for better visulization by the player of the game. The player then tosses a bean bag 40, and as it strikes a display element 12, the latter is freely rotatable about its associated support shaft 20, and rotates until such time as the upper portion of radius $R_1$ of the shaft 20 lodges in one of the correspondingly shaped angles of the associated triangular-shaped aperture 30. Because of the air-drag effect of the paddles 22, 24 and 26 as they are rotated about the shaft 20, and due to the small radius of curvature of the angles associated with the indicia panels 24 and 26, in most cases the display apparatus will come to rest with the upper portion of support shaft 20 disposed in one of the smaller equal angles whereby one or the other of the indicia paddles 24 and 26 will be displayed above the plane of the top wall 13. The game is continued until a certain number of indicia paddles are exposed, such as for example in a conventional tic-tac-toe game.

Accordingly there is provided a new and improved game apparatus of the tossing bag type, including a new and improved apparatus wherein display elements are in the form of paddle-display members, having specifically configured apertures through which the supporting shafts are disposed. Because of the specific configuration of the display apparatus, a desirable air-drag effect is achieved so as to assist in the resulting positioning of the display element, as well as the specific configuration of the support shaft and the aperture through which the shaft is disposed. The provision of an isosceles triangle aperture operates to facilitate the final positioning of a display element with one of its two indicia paddles in the display position. Furthermore, the off-setting of the triangular-shaped aperture extending through the central hub of the paddle display element insures that the displayed paddle is off-set with respect to the vertical, thereby assisting the player is visualizing the position of the various display elements during the course of the game.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A game apparatus comprising a body structure; an array of display elements positioned for viewing from a predetermined side thereof and arranged in a series of rows extending in a first direction and a series of columns extending in a second direction; a corresponding array of shafts, each secured to said body and each mounting a display element to the body structure to turn about the shaft between different display positions, each shaft being generally pear-shaped in cross-section; each display element comprising three radially extending planar positions radiating from a central hub, said hub including an aperture through which the associated shaft extends, said aperture defining in cross-section a generally isosceles triangle.

2. A game apparatus as in claim 1 wherein the apexes of the triangularly-shaped aperture are off-set with respect to the planes of said three radially extending planar portions.

3. A game apparatus as in claim 2 wherein the extend of the off-set of said planar portions with respect to the apexes of said aperture is 30° .

4. A game apparatus as in claim 1 wherein two of said radially extending planar portions include indicia thereon.

5. A game apparatus as in claim 1 further including bean bags.

6. A game apparatus as in claim 1 further including projectiles comprising a flexible bag filled with discrete particles for actuating the display elements.

7. A game apparatus as in claim 1 wherein each support shaft includes an upper radius of curvature, and wherein each of the two equal angles of said aperture has a radius of curvature corresponding to the radius of curvature of said upper radius of curvature of the support shaft.

* * * * *